US009622533B2

(12) United States Patent
Warmouth et al.

(10) Patent No.: US 9,622,533 B2
(45) **Date of Patent: *Apr. 18, 2017**

(54) SINGLE-LAYER PADDING SYSTEM

(71) Applicant: KRANOS IP CORPORATION, Litchfield, IL (US)

(72) Inventors: Cortney Warmouth, Edwardsville, IL (US); Louis Anthony Vanhoutin, Iuka, IL (US); Vincent R. Long, St. Peters, MO (US); Jeff Musec, Edwardsville, IL (US)

(73) Assignee: KRANOS IP CORPORATION, Litchfield, IL (US)

( * ) Notice: Subject to any disclaimer, the term of this patent is extended or adjusted under 35 U.S.C. 154(b) by 77 days.

This patent is subject to a terminal disclaimer.

(21) Appl. No.: 14/209,259

(22) Filed: Mar. 13, 2014

(65) Prior Publication Data

US 2015/0257471 A1 Sep. 17, 2015

(51) Int. Cl.

| | |
|---|---|
| ***A42B 3/00*** | (2006.01) |
| ***A42B 3/12*** | (2006.01) |
| *A41D 31/00* | (2006.01) |

(52) U.S. Cl.

CPC ..... *A42B 3/122* (2013.01); *A42B 3/124* (2013.01); *A42B 3/127* (2013.01); *A41D 31/0044* (2013.01)

(58) Field of Classification Search

CPC ..... A42B 3/064; A42B 3/125; A42B 3/122; A42B 3/127; A42B 3/128; A42B 3/124; A42B 3/06; A42B 3/00; A41D 31/004; A41D 13/15

USPC ..... 2/411–419, 455, 456, 267, 24, 69

See application file for complete search history.

(56) References Cited

U.S. PATENT DOCUMENTS

| | | | | |
|---|---|---|---|---|
| 3,039,109 | A * | 6/1962 | Simpson | A42B 3/121 2/413 |
| 3,720,955 | A * | 3/1973 | Rawlings | A42B 3/127 2/415 |
| 4,354,284 | A * | 10/1982 | Gooding | A42B 3/121 2/413 |
| 6,443,513 | B1 | 9/2002 | Glance | |
| 6,682,128 | B2 * | 1/2004 | Carroll, III | A62B 1/22 188/371 |
| 6,923,494 | B2 | 8/2005 | Shuler | |
| 6,938,290 | B2 * | 9/2005 | McKinney | A47C 7/021 297/452.27 |
| 7,328,462 | B1 * | 2/2008 | Straus | A42B 3/067 2/411 |
| 7,404,593 | B2 | 7/2008 | Cormier | |
| 7,673,351 | B2 | 3/2010 | Copeland | |
| 7,866,716 | B2 | 1/2011 | Perucca | |
| 8,739,317 | B2 * | 6/2014 | Abernethy | A42B 3/121 2/410 |
| 9,516,910 | B2 * | 12/2016 | Szalkowski | A42B 3/127 |

(Continued)

*Primary Examiner* — Anna Kinsaul
*Assistant Examiner* — Jillian K Pierorazio
(74) *Attorney, Agent, or Firm* — Notaro, Michalos & Zaccaria P.C.

(57) ABSTRACT

An impact-absorbing padding system made of a single-layer thermoplastic polyurethane sheet. The bottom of the sheet is flat, and the top side is also flat and has multiple, spaced apart projections. The projections are frustaconal in shape, having a flat top side and an open bottom. At least some of the projections are connected by ribs. The number and height of the ribs varies to achieve variable hardness within the system.

23 Claims, 20 Drawing Sheets

(56) References Cited

U.S. PATENT DOCUMENTS

| | | | | |
|---|---|---|---|---|
| 2005/0133324 | A1* | 6/2005 | Soto Bailon | B60R 21/04 188/377 |
| 2010/0258988 | A1* | 10/2010 | Darnell | A42B 3/064 267/141 |
| 2010/0295221 | A1* | 11/2010 | Kligerman | F16F 1/373 267/140.11 |
| 2010/0299812 | A1* | 12/2010 | Maddux | A42B 3/124 2/414 |
| 2011/0296594 | A1* | 12/2011 | Thomas | A42B 3/124 2/414 |
| 2012/0030850 | A1* | 2/2012 | Wood | A41D 13/065 2/24 |
| 2012/0186004 | A1* | 7/2012 | Mechling | A42B 3/20 2/425 |
| 2013/0152287 | A1* | 6/2013 | Cormier | A41D 13/0156 2/459 |
| 2014/0325745 | A1* | 11/2014 | Erb | A42B 3/127 2/414 |
| 2016/0255898 | A1* | 9/2016 | Cormier | A41D 13/08 |

* cited by examiner

SINGLE-LAYER PADDING SYSTEM

FIELD AND BACKGROUND OF THE INVENTION

The present invention relates generally to the field of protective padding for use in helmets, and in particular to a new and useful single-layer padding assembly for use in various helmet types, including sports helmets. The invention is also directed to a helmet-and-padding system.

U.S. Pat. No. 6,443,513 to Glance teaches an energy absorbing device which is formed of natural or synthetic resin material or composite material, wherein energy absorption is provided by a plurality of cup-shaped cells having a thin-walled construction with a circular cross section. The absorber is specified as useful for automotive bumper impact, but the specification adds that it is also for other applications, including general cushion applications.

U.S. Pat. No. 6,923,494 to Shuler et al. teaches an energy absorber incorporated into a front bumper system on automotive vehicles. It includes a unitary molded glass mat of thermoplastic material having a plurality of outwardly extending crushable lobes. The energy absorber is combined with a fascia and a reinforcing beam with the energy absorber interdisposed to form a bumper system for automotive vehicles.

U.S. Pat. No. 7,866,716 to Perucca et al. teaches an energy absorber for a vehicle bumper system which includes multiple crush boxes that are configured to absorb impact energy. Each of the crush boxes is generally hollow and has a front wall and a plurality of side walls integrally formed with and extending from the front wall to a rear of the energy absorber.

U.S. Pat. No. 7,404,593 to Cormier teaches a modular energy absorber that is tunable. It includes one or more energy absorbing modules. The energy absorbing modules have means for coordinating energy absorbing units of the one or more modules. The absorber also has a crushable member that has an upper perimeter, a lower perimeter and an intermediate wall extending therebetween. It also includes a number (m) of breaches defined therein before impact.

U.S. Pat. No. 7,673,351 to Copeland et al. teaches a shock absorbing structure comprising a generally planar surface made of a flexible plastic material. A plurality of upstanding, hollow support members extends from the planar surface. The support members are made of flexible plastic material. There is also a plurality of openings in each of the support members, the openings define air passages within the shock absorbing structure to allow air to flow through the support members. The shock absorbing structure may be used in helmets.

A need remains for further advancements in the field of helmet padding design, in particular for a helmet padding system which provides optimal protection for the head of the wearer without adding excess weight. There also remains a need for a padding system which is inexpensive to manufacture and install in a sports helmet, relative to existing padding systems, which typically involve excessive materials and assembly steps to achieve maximal protection.

SUMMARY OF THE INVENTION

Accordingly one of the various objects of the invention is to provide a padding system that provides significant protection without adding undue weight It is also an object of the present invention to provide an impact-absorbing padding, which is made of a single-layer thermoplastic polyurethane (TPU) sheet. The sheet has a bottom side and a top side. The bottom side is flat, and the top side is also flat and has multiple, spaced apart projections. The projections are frustaconal in shape, having a flat top side and an open bottom. The sheet has multiple holes located in the sheet equidistant from all adjacent projections.

Another object of the invention is to provide a padding which, in use, is positioned on the inside of a protective helmet shell such that the flat bottom side faces the wearer's head. A comfort liner may be used between the bottom side of the padding and the wearer's head.

The projections are also connected to one another by ribs. The ribs are continuous with the top side of the flat sheet and extend up the projection to a point part way between the bottom of the projection and its top. In certain portions of the padding, there are four ribs to each projection. In other portions, there are fewer than four ribs to a projection. Some of the projections are free-standing, having no ribs attached to them.

The proposed padding system is also provided with a U-shaped portion, which is for facilitating securement of an inflatable liner system. In preferred embodiment, this U-shaped portion is in a crown padding region, but it is within the scope of the invention for it to be in any convenient region of the padding system.

The present invention is also directed a helmet-and-padding assembly, namely a sports helmet assembly with variable-rigidity in selected areas of the helmet to improve the impact attenuating characteristics of the helmet, while maintaining the most comfort for the wearer.

In the helmet-and-padding assembly, the padding is hardest at the region, just above edge of the front side of the helmet and becomes softer as it goes up, with the crown padding being softer than the front pad.

In certain embodiments, this variable rigidity is achieved by providing more numerous ribs in the forehead area and/or providing taller ribs in the forehead area for higher rigidity. Lesser rigidity is achieved by decreasing the height and number of ribs upwards along the pad toward the crown.

The side pads are softer than the front and crown pads, having shorter ribs and, in certain embodiments, no ribs at all.

Thus, an object of the present invention is to achieve a variable-hardness padding assembly while maintaining a uniform the thickness of the TPU material throughout the system. This provides a significant cost advantage, by reducing the cost of the injection molding process. According the invention the durometer of the TPU material is preferably, but not limited to the range of 75-Shore-A to 115-Shore-A. The durometer of the TPU is more preferably in the range of 85-Shore-A to 105-Shore-A. The durometer of the TPU is more preferably in the range of 90-Shore-A to 100-Shore-A.

A still further object of the invention is to provide a sports helmet with padding system that is fastened to the inside surface of the shell using mechanical fasteners that extend through the shell, preferably in the form of T-nuts or similar mechanical fasteners at strategic locations in the helmet shell, rather than the hook-and-loop tapes typically used for this purpose. This greatly improves ease of assembly of the padding system in the helmet shell initially, and expedites replacing the padding system that is performed as part of the reconditioning of a sports helmet, for example, before the start of each new season.

At least one of the projections has openings or slits near the top of the projection, along its sides, as well as an opening at the top. The openings on the sides and the top are oriented so that they may accommodate a male T-nut (for connecting to a helmet). The openings are oriented so that the top of a male T-nut inserted into the projection would protrude from the top of the projection and the corners of the base of the T-nut would protrude from the openings/slits along the side of the T-nut.

In certain embodiments, in place of the single-layer side padding and back padding, there is provided a dilatant cushioning. The dilatant cushioning is a shear-thickening material.

The present padding system may be employed in a helmet for football, lacrosse, baseball, softball, or any sports. The present padding system may be, as well, employed in any helmet, including helmets for non-sports contexts. It is well within the scope of the invention for the padding system to employed outside the context of helmets altogether, including, but not limited to, any situation in which impact absorption or attenuation is desired.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
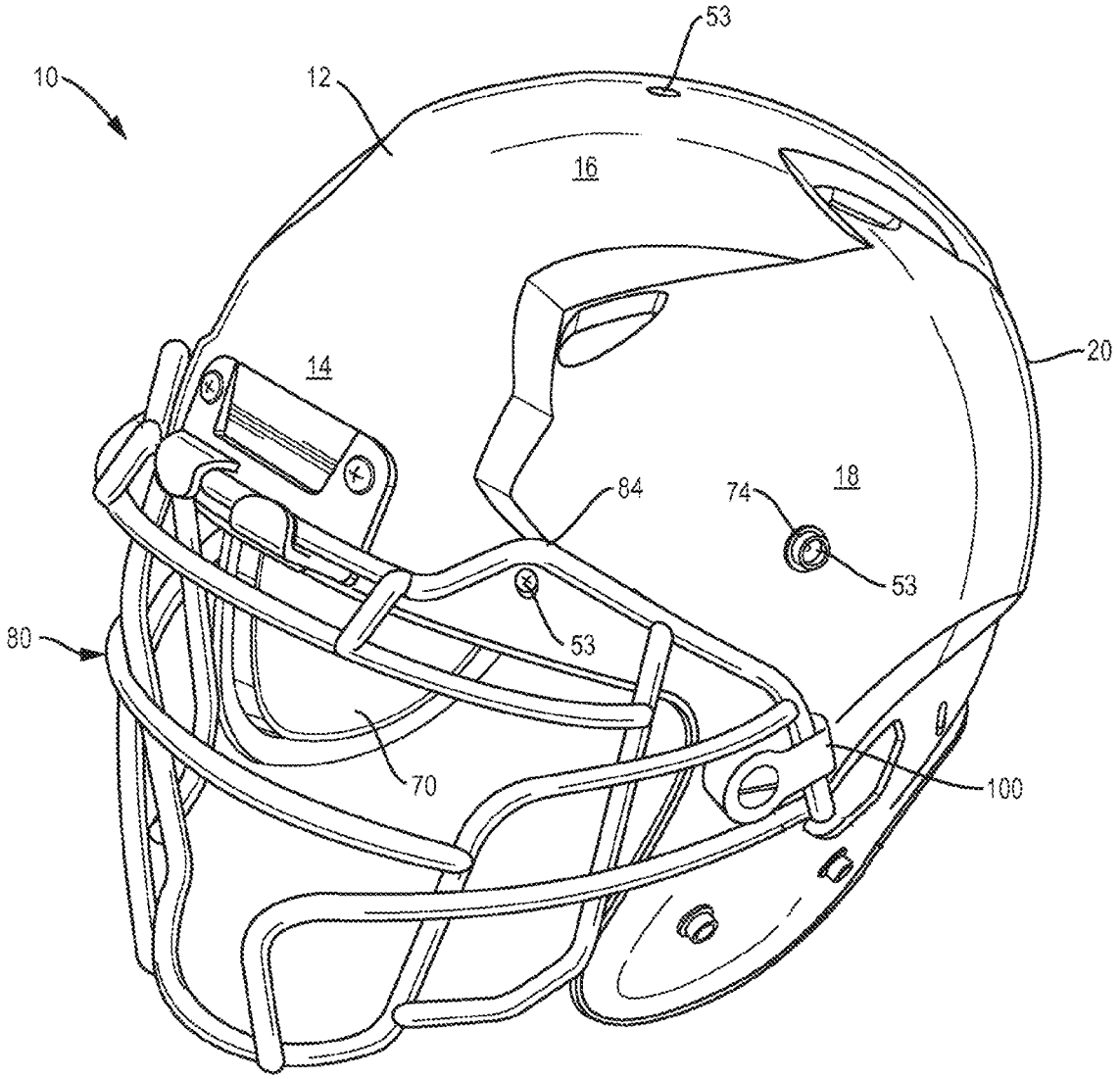
FIG. 1 is a perspective view of a football helmet according to the present invention.
Figure 2:
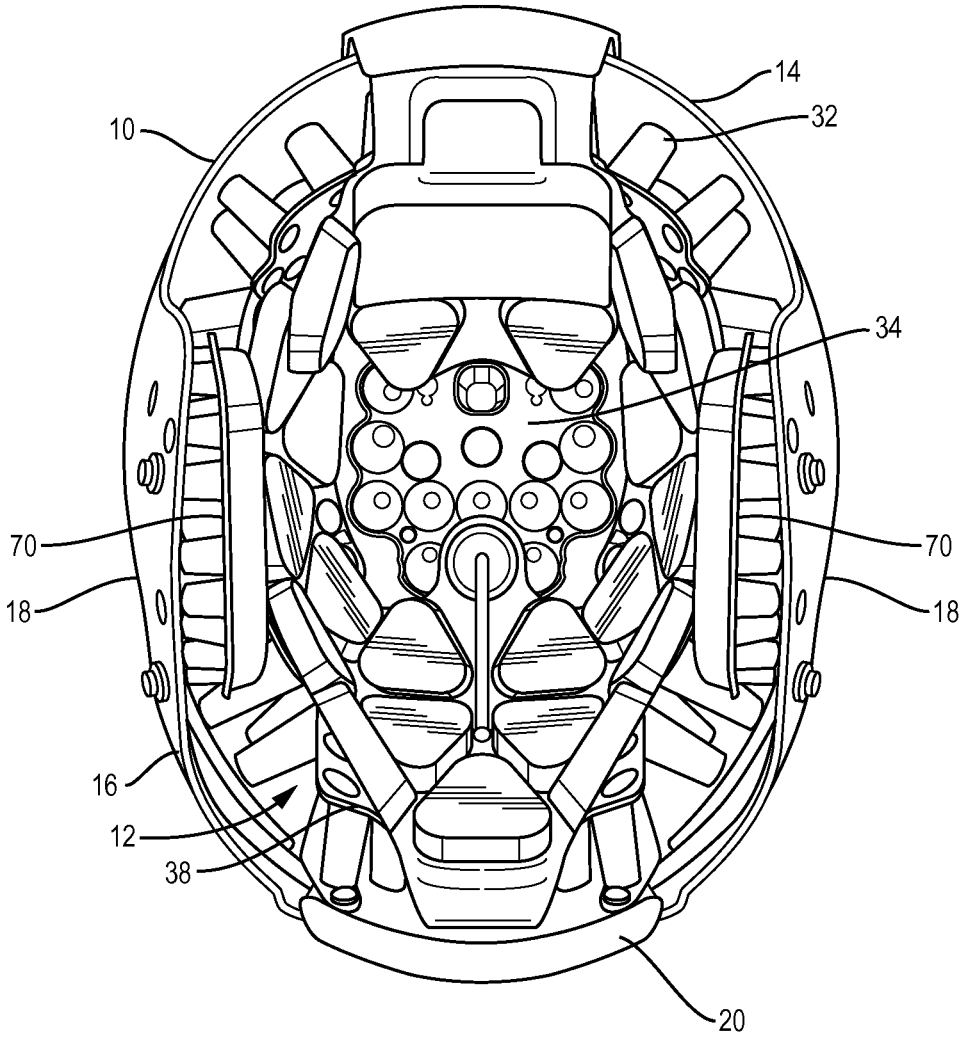
FIG. 2 is a bottom plan view of the helmet-and-padding assembly, revealing the arrangement of the first embodiment of the padding system inside the helmet.
Figure 3:
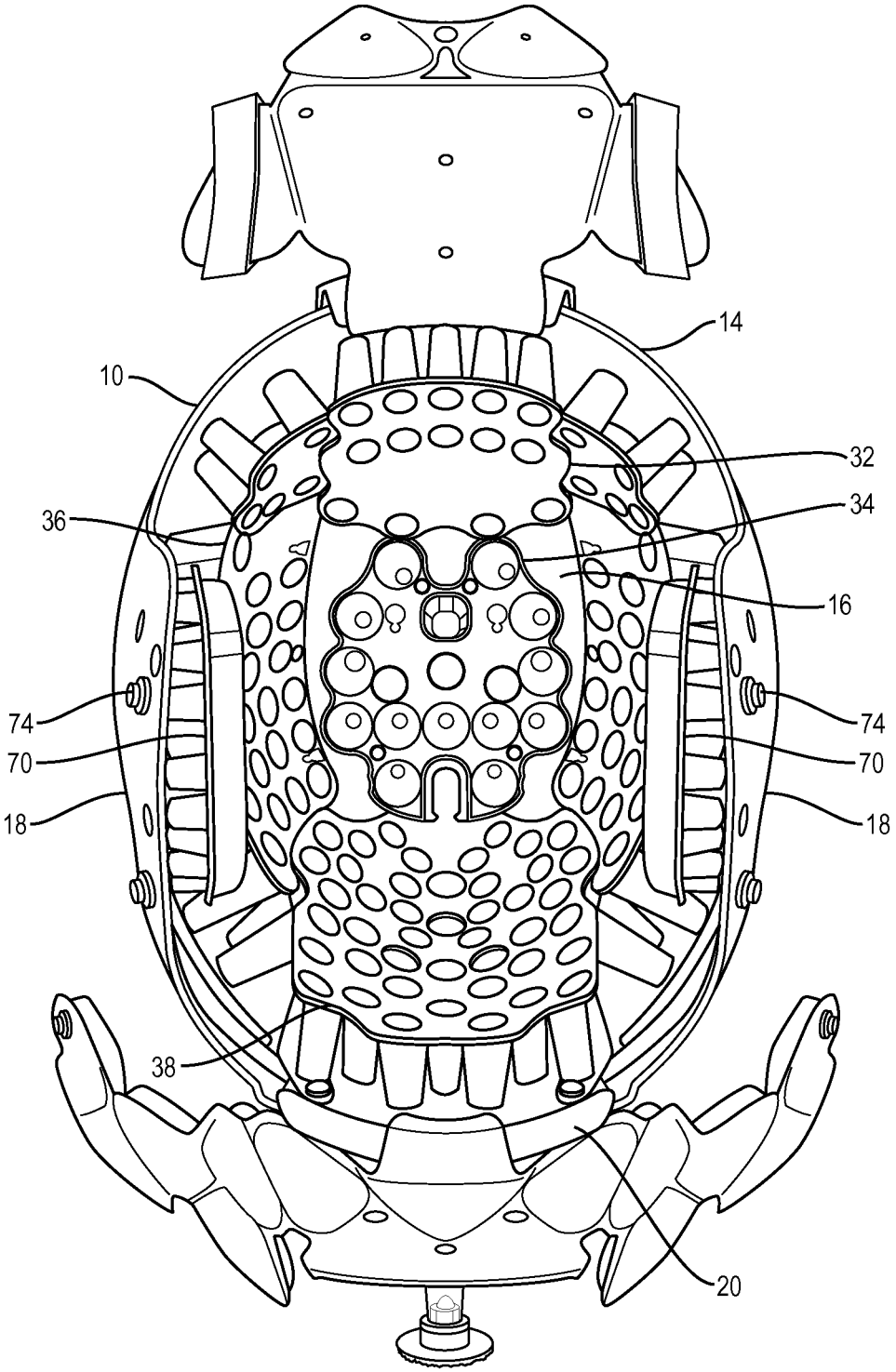
FIG. 3 is a view similar to FIG. 2, but with a comfort liner assembly pealed away to reveal the first embodiment of the padding system inside the helmet.

Referring now to the drawings, in which like reference numerals are used to refer to the same or similar elements, FIG. 1 shows a football helmet shell 10 adapted to cover the head of a wearer, the rigid shell having an outer surface and an inner surface, the inner surface having selected concave curvatures at various portions of the shell as can be better appreciated from FIGS. 2 and 3.

Returning to FIG. 1, the helmet shell 10 has a front portion 14 for covering the forehead of the wearer, a crown portion 16 for cover the top of the wearer's head, a pair of opposite side portions 18 for covering the sides of the wearer's head, and a back portion 20 for covering the back of the wearer's head.

As shown in FIGS. 2 and 3, a first embodiment of the padding system 12 is removably attached to the inner surface of the helmet shell 10 and comprises a plurality of impact absorbing pads 32, 34, 36, 38 that are spaced apart on the inner surface of the shell and that conform to the inner concave curvatures at the various portions of the helmet shell 10. The padding system 12 comprises a front pad 32 that is removably attached at the front portion 14 of the helmet shell 10, a crown pad 34 that is removably attached at the crown portion 16 of the shell, a pair of side pads 36 removably attached at the respective side portions 18 of the shell, and a back pad 38 removably attached at the back portion 20 of the helmet shell 10.

As shown in FIGS. 2 and 3, the padding system 12 also includes a pair of jaw pads 70 connected to the inner surface of the side portions 18 of shell 12 by snap fasteners 74 and as disclosed in U.S. Pat. No. 8,201,269. U.S. Pat. No. 8,201,269 is incorporated herein by reference for its teaching of protective jaw pads for a helmet.

As best shown in FIGS. 4-6, and 9 each pad is a single-layer of injection molded thermoplastic urethane (TPU) having a plurality of spaced apart, hollow projections 42 extending to the inner surface of the helmet shell 10.

Each projection 42 has an open, larger diameter base **42*b* at the top side of the sheet 42*a* from which it extends, a smaller diameter peak 42*c*, and a side wall 42*d* that tapers from the base 42***b* to the peak 42*c* for each projection, each base 42*b*, side wall 42*d* and peak 42*c* being molded of one piece of TPU with the top side of the sheet 42*a* from which they extend. Upon an impact on the outer surface of the helmet shell 10 and a resulting relative movement of the helmet shell 10 with respect to the head of the wearer, the small diameter peaks 42*c* in the areas of the impact, collapse to dissipate the impact with reduced pressure on the head of the wearer.

In the front portion 14, crown portion 16 and side portions 18, the diameter of the larger diameter base 42*b* is in the range of 0.3200 inches to 1.080 inches. In more preferred embodiments, the diameter of the larger diameter base 42*b* is in the range of 0.3600 inches to 0.9900 inches. In most preferred embodiments, the diameter of the larger diameter base 42*b* is in the range of 0.4000 inches to 0.9000 inches.

In the front portion 14, crown portion 16 and side portions 18, the diameter of the small diameter peak 42*c* is in the range of 0.2000 inches to 1.0800 inches. In more preferred embodiments, the diameter of the small diameter peak 42*c* is in the range of 0.2250 inches to 0.9900 inches. In most preferred embodiments, the diameter of the small diameter peak 42*c* is in the range of 0.2500 inches to 0.9000 inches.

In the jaw pads 70, the diameter of the larger diameter base 42*b* is in the range of 0.1500 inches to 0.3000 inches. In more preferred embodiments, the diameter of the larger diameter base 42*b* is in the range of 0.1688 inches to 0.2750 inches. In most preferred embodiments, the diameter of the larger diameter base 42*b* is in the range of 0.1875 inches to 0.2500 inches.

In the jaw pads 70, the diameter of the small diameter peak 42*c* is in the range of 0.2000 inches to 0.3600 inches. In more preferred embodiments, the diameter of the small diameter peak 42*c* is in the range of 0.2250 inches to 0.3300 inches. In most preferred embodiments, the diameter of the small diameter peak 42*c* is in the range of 0.2500 inches to 0.3000 inches.

As discussed above, the present padding system may be employed in a helmet for football, lacrosse, baseball, softball, among other sports.

In the football helmet padding system, the large diameter base 42*b* has a diameter in the range of 0.4000 inches to 0.9000 inches. The diameter of the small diameter peak 42*c* is in the range of 0.2500 inches to 0.5000 inches.

In the lacrosse helmet padding system, the large diameter base 42*b* has a diameter in the range of 0.5000 inches to 0.7500 inches. The diameter of the small diameter peak 42*c* is in the range of 0.6250 inches to 0.9000 inches.

In the baseball helmet padding system, the large diameter base 42*b* has a diameter in the range of 0.1875 inches to 0.2500 inches. The diameter of the small diameter peak 42*c* is in the range of 0.2500 inches to 0.3000 inches.

In certain embodiments, the thickness of the side wall 42*d* is in the range of 0.0250 inches and 0.0750 inches. In more preferred embodiments, the thickness of the side wall 42*d* is in the range of 0.0300 inches and 0.0650 inches. In most preferred embodiments, the thickness of the side wall 42*d* is in the range of 0.0350 inches and 0.0600 inches.

In certain embodiments, the height of the projections 42 is in the range of about 0.1000 inches to about 1.8000 inches. In more preferred embodiments, the height of the projections 42 is in the range of about 0.1500 inches to about 1.6500 inches. In most preferred embodiments, the height of the projections 42 is in the range of about 0.1700 inches to about 1.500 inches.

In football helmet padding system embodiments, the height of the projections 42 is in the range of about 0.5000 inches to about 1.5000 inches, in certain embodiments. In more preferred embodiments, the height of the projections 42 is in the range of about 0.55 inches to about 1.3750 inches. In most preferred embodiments, the height of the projections 42 is in the range of about 0.6250 inches to about 1.2500 inches.

In lacrosse helmet padding system embodiments, the height of the projections 42 is in the range of about 0.10 inches to about 1.2 inches, in certain embodiments. In more preferred embodiments, the height of the projections 42 is in the range of about 0.15 inches to about 1.1 inches. In most preferred embodiments, the height of the projections 42 is in the range of about 0.1875 inches to about 1.0 inches.

In baseball and softball padding system embodiments, the height of the projections 42 is in the range of about 0.2000 inches to about 0.6000 inches, in certain embodiments. In more preferred embodiments, the height of the projections 42 is in the range of about 0.2250 inches to about 0.5500 inches. In most preferred embodiments, the height of the projections 42 is in the range of about 0.2500 inches to about 0.5000 inches.

The front pad 32, crown pad 34 and back pad 38 are provided with ribs 44, each of the ribs 44 being continuous with the top side of the sheet 42*a* and extending up along the side wall 42*d* of at least one projection to a point at least part way between an edge of the top end of the projection 42 and the top side of the sheet 42*a*.

It is within the scope of the invention for the variation in hardness to be achieved by adding more ribs 44 or providing taller ribs 44 in the bottom of the front pad 32 and reducing the height and number of ribs 44 between the projections moving up the padding system 12 towards the crown pad 34.

In certain embodiments, the height of the smallest rib 44 in a particular pad is about 20% of the height of the tallest rib 44. In certain embodiments, the height of the smallest rib 44 in a particular pad is about 50% of the height of the tallest rib 44. In certain embodiments, the height of the smallest rib 44 in a particular pad is about 75% of the height of the tallest rib 44. In certain embodiments, the height ribs 44 in a particular pad are about the same.

It is also within the scope of the invention to change the hardness from bottom to top by changing the density of projections 42 per unit area. In preferred embodiments, the thickness of the TPU material is uniform within a particular pad, which provides an advantage in that it allows for production by a simple injection-molding process. However, it is well within the scope of the invention to vary the durometer within a particular pad. In preferred embodiments, the durometer of the material is in the range of about 75 Shore-A to about 115-Shore-A. The durometer of the TPU is more preferably in the range of about 85-Shore-A to about 105-Shore-A. The durometer of the TPU is more preferably in the range of about 90-Shore-A to about 100-Shore-A.

The padding is hardest at the region which covers the bottom of forehead, just above edge of the front side of the helmet and becomes softer as it goes up, with the crown padding 34 being softer than the front pad 32 and having a uniform rigidity.

The side pads 36 are softer than the front 32 and crown pads 34, having shorter ribs 44 having no ribs in certain embodiments.

Figure 10:
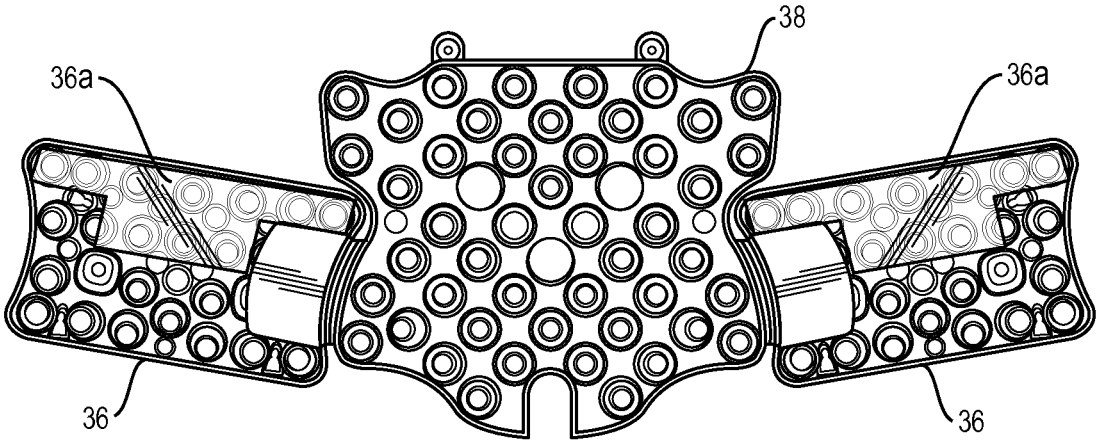
FIG. 10 is a top plan view of the back and side pads of the first embodiment of the padding system laid out, showing the T-rib feature of the side pads and the a manner in which the back and side pads may be fused.
Figure 11:
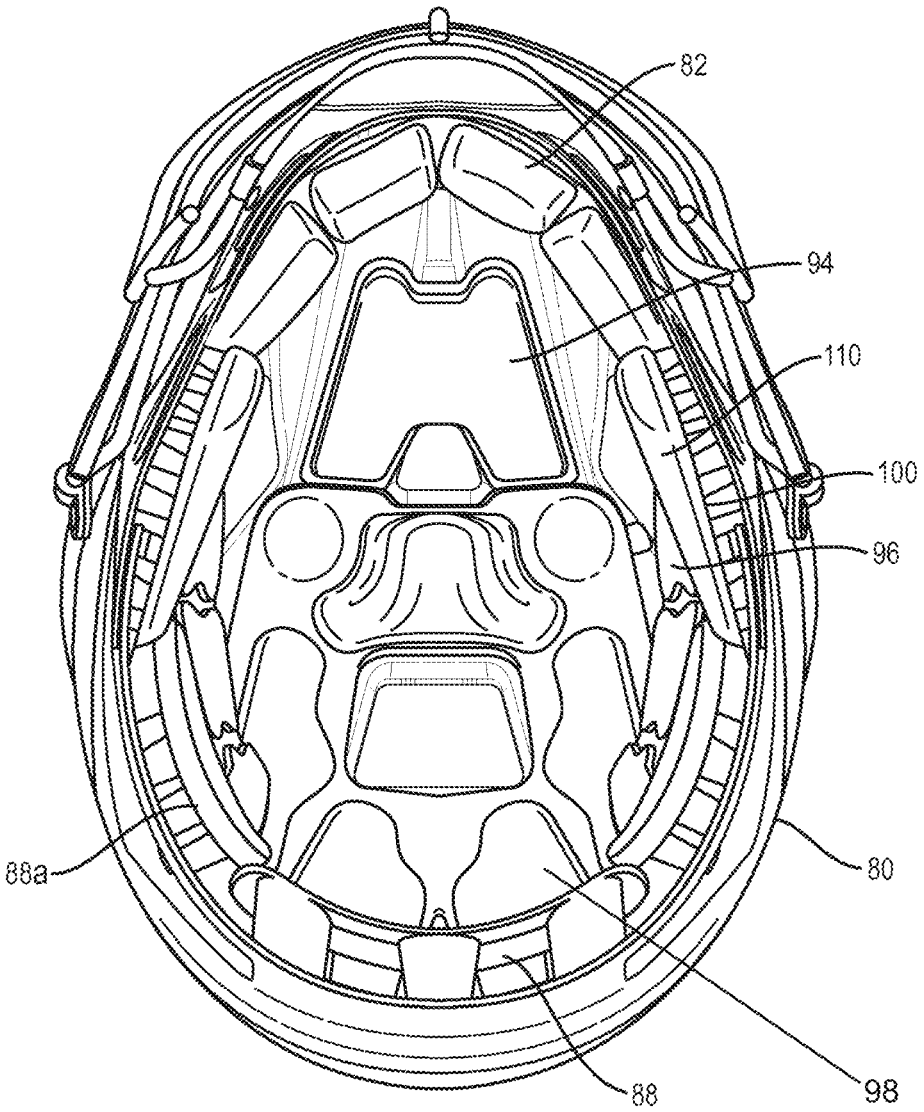
FIG. 11 is a bottom plan view of a helmet-and-padding assembly, revealing the arrangement of the fifth embodiment of the padding system inside the helmet.
Figure 12:
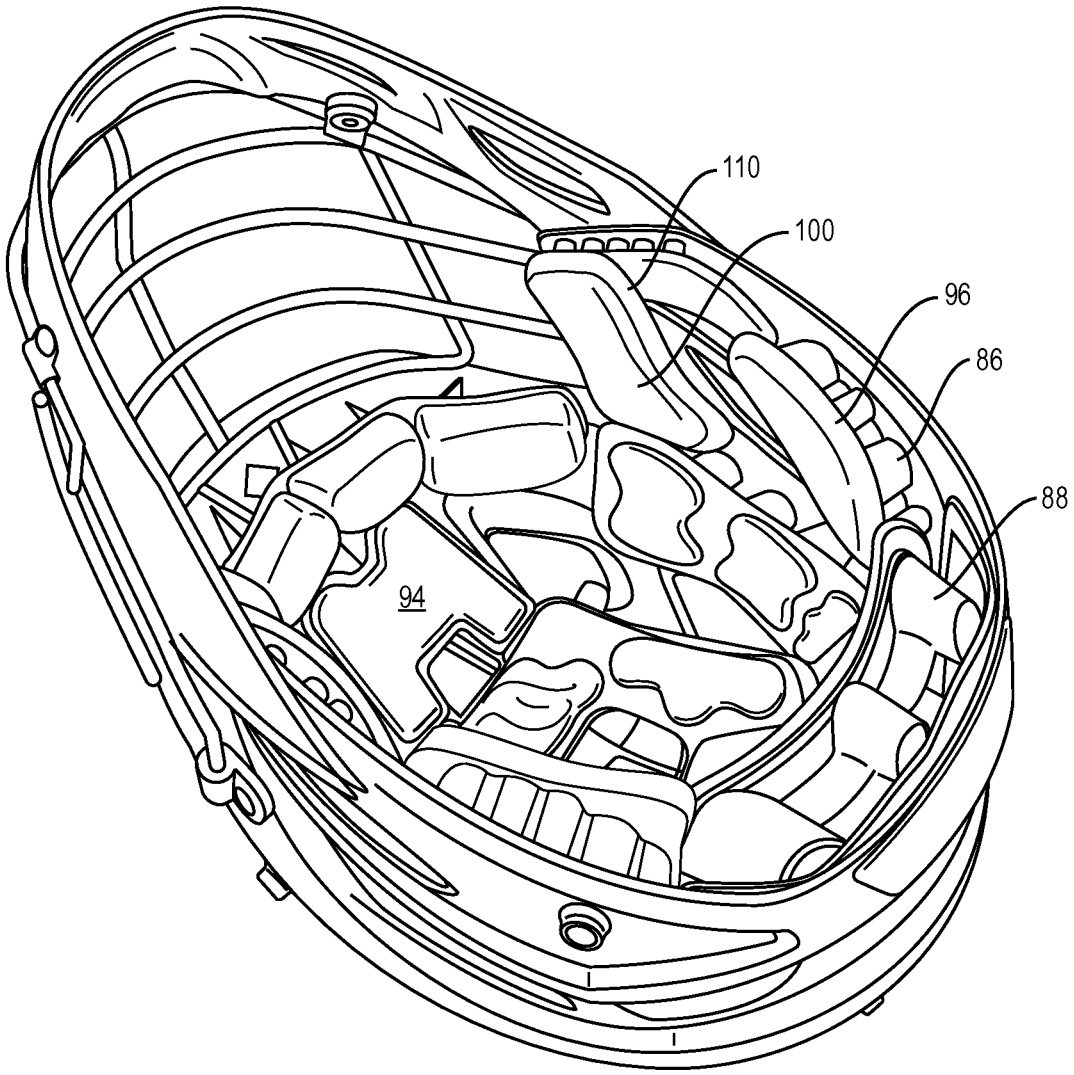
FIG. 12 is a bottom perspective view of the helmet-and-padding assembly of FIG. 9, revealing the arrangement of the fifth embodiment of the padding system inside the helmet.

As illustrated in FIG. 10, in certain embodiments, the side pads 36 are provided with T-ribbing 36*a* for improving the rigidity of the padding.

In these embodiments, the T-ribbing is a T-shaped piece of thin TPU plastic fused to the peaks 42*c* of certain of the projections 42.

According to the invention and contrary to current practice in the assembly of sports helmets, at least some of the pads of the padding system 12 are removably attached to the inside surface of shell by mechanical fasteners extending through the shell 12, such as T-nuts shown for example in FIGS. 2, 3, 9, 11, and 12, having flange nut 51 with a threaded tube for engaging a hole in the pad and for extending through a hole in the shell, and a treaded screw 53, treaded to the threaded tube and extending from an outer surface of the shell. The head of a screw 53 for connecting the crown pad 34 is visible at the top of the helmet shell in FIG. 1.

At least some of the pads have one or more keyholes 52 therein, each keyhole, as best shown in FIGS. 3-7, having a large diameter, semicircular portion, a small diameter circular portion communicating with the large diameter portion, and a curved, hour-glass shaped constricted passage between the large and small diameter portions that is smaller than the small diameter portion so that the keyhole is generally bell-shaped. These keyholes 52 are for removably receiving resilient buttons 54 and stems 56 on the outer surfaces of the liners as will be explained later, for removably connecting the liners to the padding system 12 in an improved manner.

As with the use of mechanical fasteners to removably connect the padding system 12 to the helmet shell, the use of keyholes 52 and buttons facilitates the removable connection of the liners to the padding system 12 without the use of hook-and-loop fasteners that cannot be placed with great precision nor can they be engaged with great precision. These improved mounting arrangements improve the initial assembly and all later reconditioning of the helmet over what has been the norm in the field.

Referring now to FIGS. 18-25, the helmet includes a comfort liner assembly 60 that is removably attached to inner surfaces of the inner sheets of the pads of the padding system 12. The comfort liner assembly 60 comprises a front liner 62 at an inner surface of the front pad 32, a crown liner 64 at an inner surface of the crown pad 34, and a lateral liner comprising a pair of side cushion assemblies 66 at inner surfaces of the respective pair of side pads 36, and a back cushion assembly 68 at an inner surface of the back pad 38.

Figure 4:
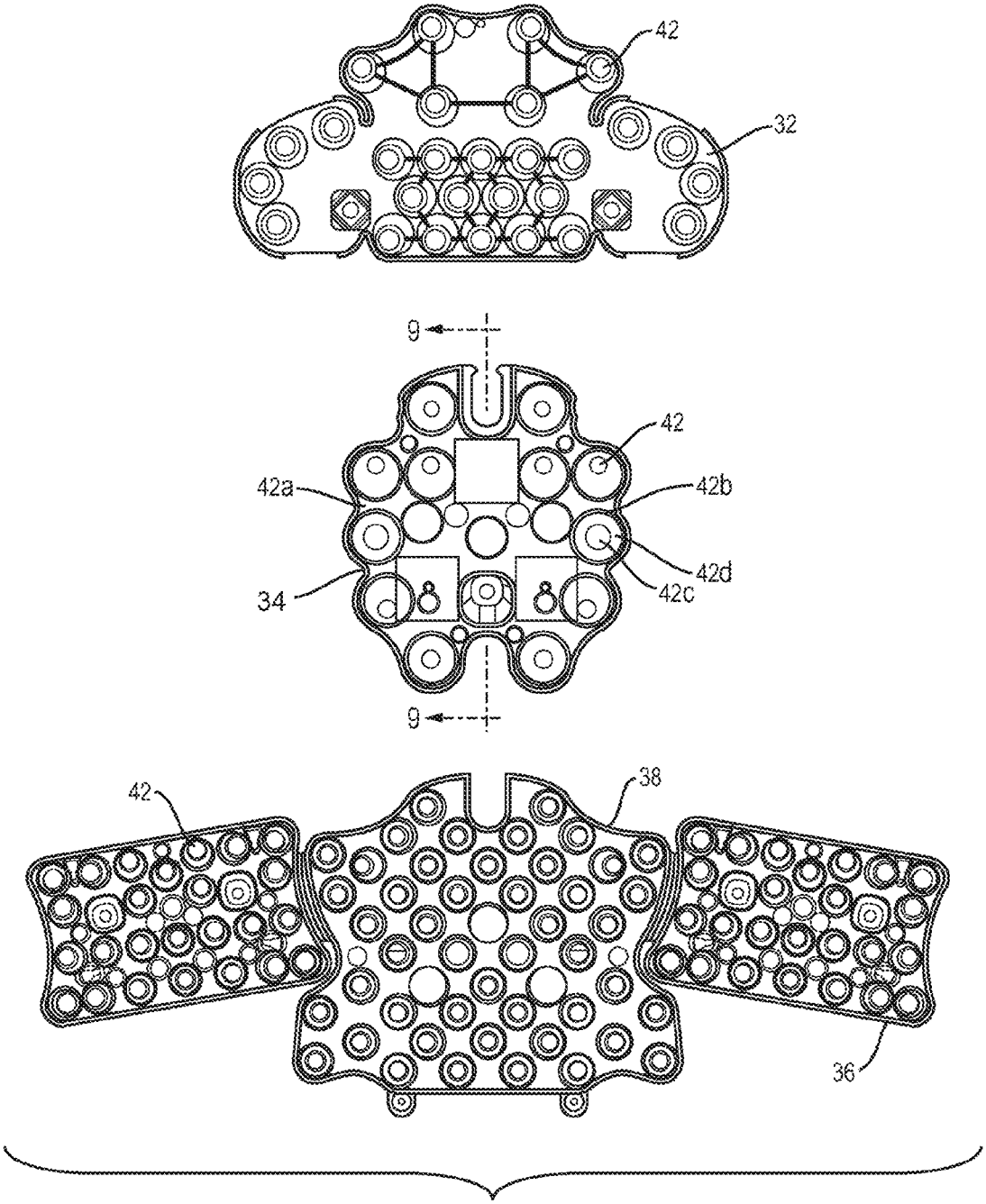
FIG. 4 is a top plan view of the first embodiment of the padding system laid out.
Figure 5:
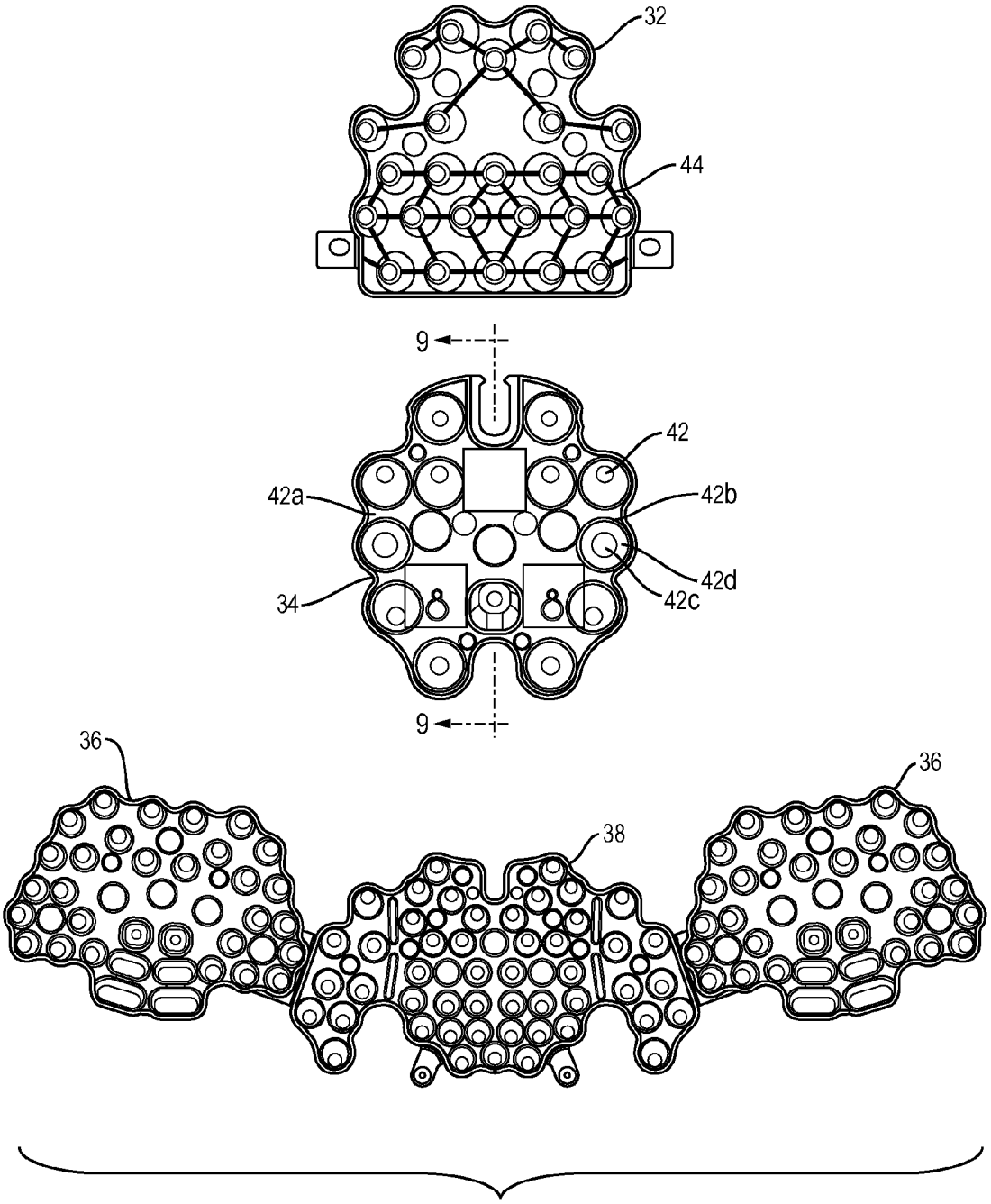
FIG. 5 is a top plan view of the second embodiment of the padding system laid out.
Figure 6:
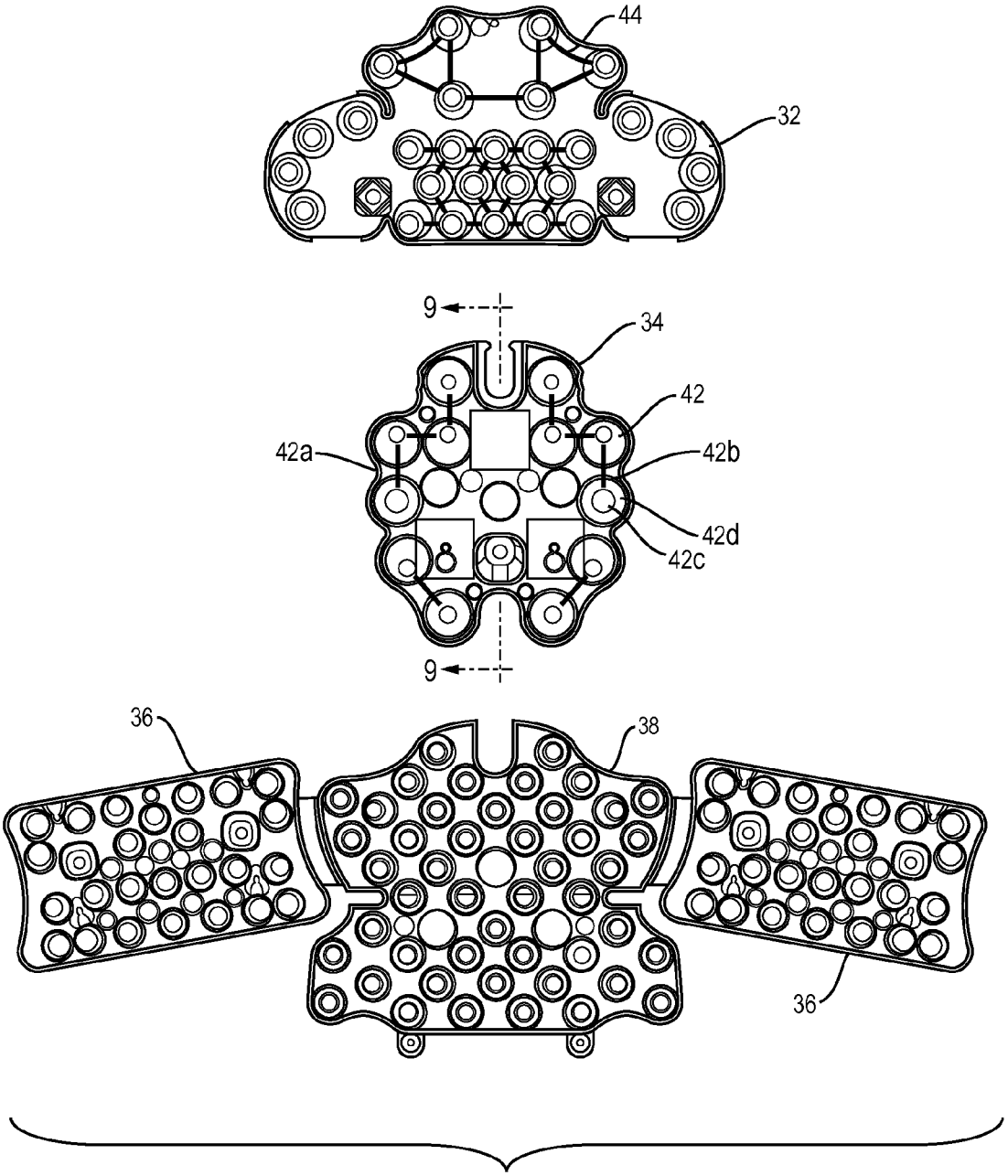
FIG. 6 is a top plan view of the third embodiment of the padding system laid out.
Figure 20:
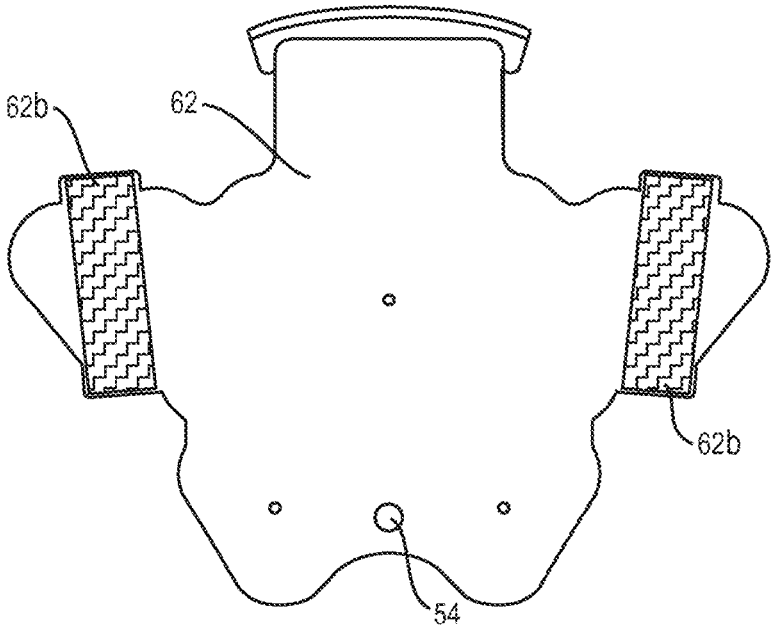
FIG. 20 is an outer surface view of the front liner.
Figure 21:
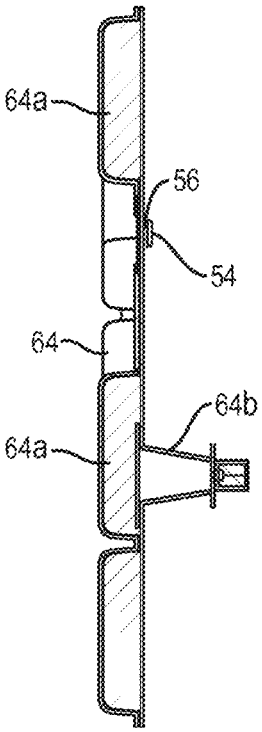
FIG. 21 is a sectional view of a crown liner of the comfort liner assembly.
Figure 22:
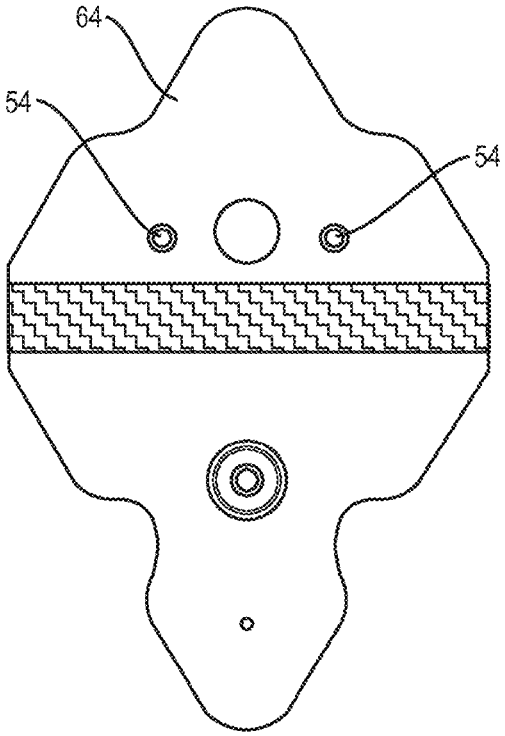
FIG. 22 is an outer surface view of the crown liner.
Figure 23:
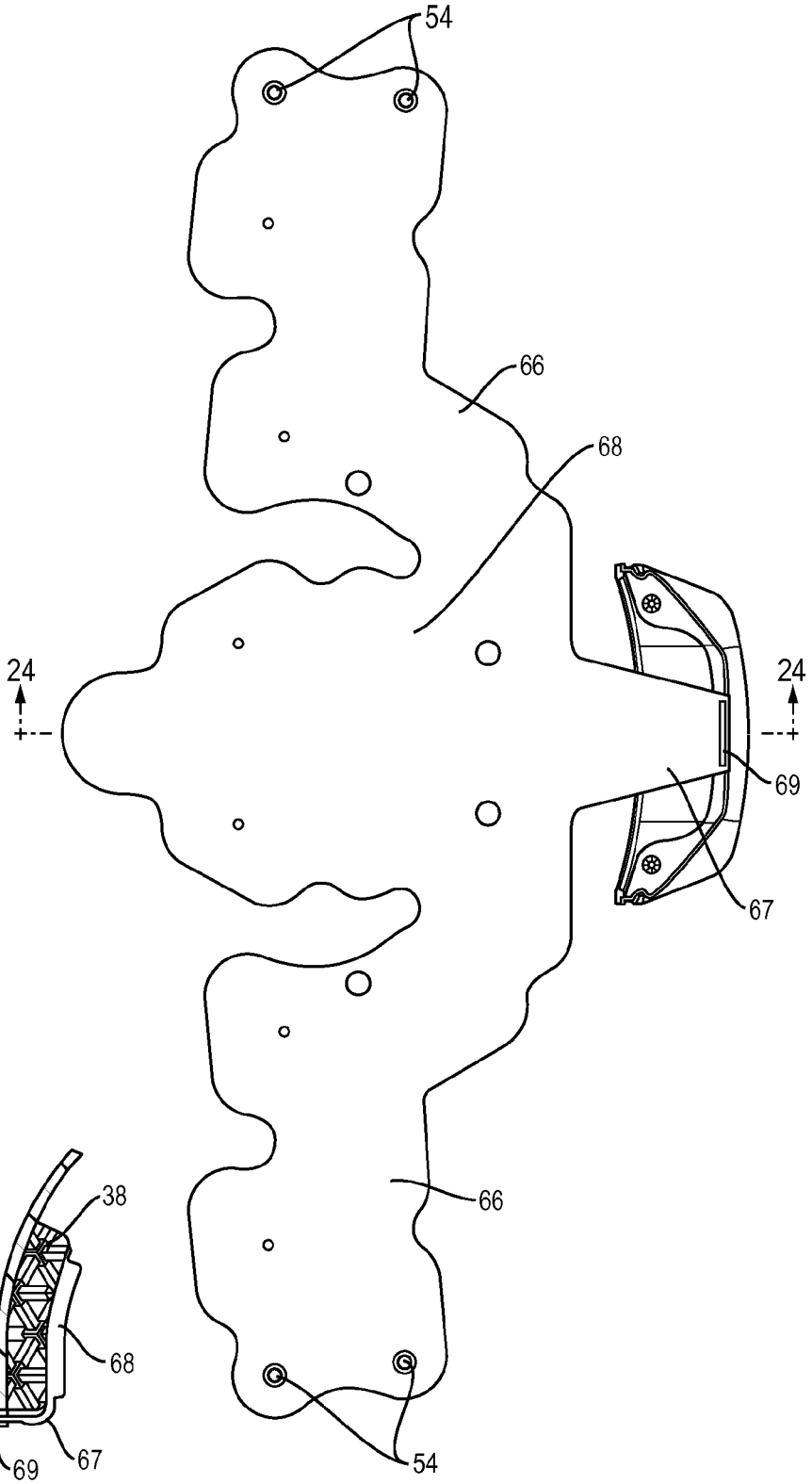
FIG. 23 is an outer surface view of a lateral liner of the comfort liner assembly.

The liners that are over at least some of the pads have one or more resilient buttons 54 each with a resilient stem 56, formed with or fused to an outer plastic sheet of the liners, for engaging each respective keyhole 52, each button 54 having a diameter for being received in a respective large diameter portion 52*a* of a keyhole 52 and each stem having a diameter that is larger than the constricted passage 52*c* and of a size for being received in a respective small diameter portion 52*b* of a respective keyhole 52, so that each button 54 is removably trapped at a respective keyhole 52. As shown in FIG. 20, front liner 62 has one button 54, in FIG. 22 crown liner 64 is shown to have two buttons 54 and as shown in FIG. 23, lateral liner 66, 68 has four button 54. Corresponding keyholes 52 in the front, crown, and side pads are shown in FIGS. 4-6.

Figure 19:
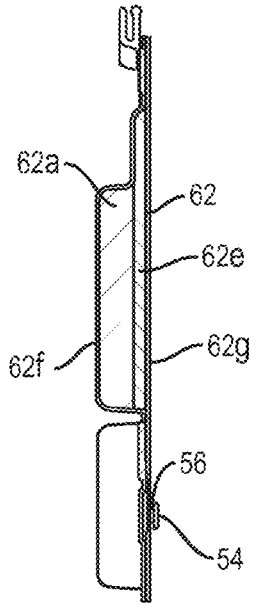
FIG. 19 is a sectional view of a front liner of the comfort liner assembly.

To help further connect the front liner 62 to and over the front pad 32, and as shown in FIG. 19, a pair of elastic strapping or bands 62*b* are fixed at opposite sides to the front liner 62 and engage around the side parts 32*a* of the front pad 32 for removable connecting the front liner to the front pad.

Figure 17:
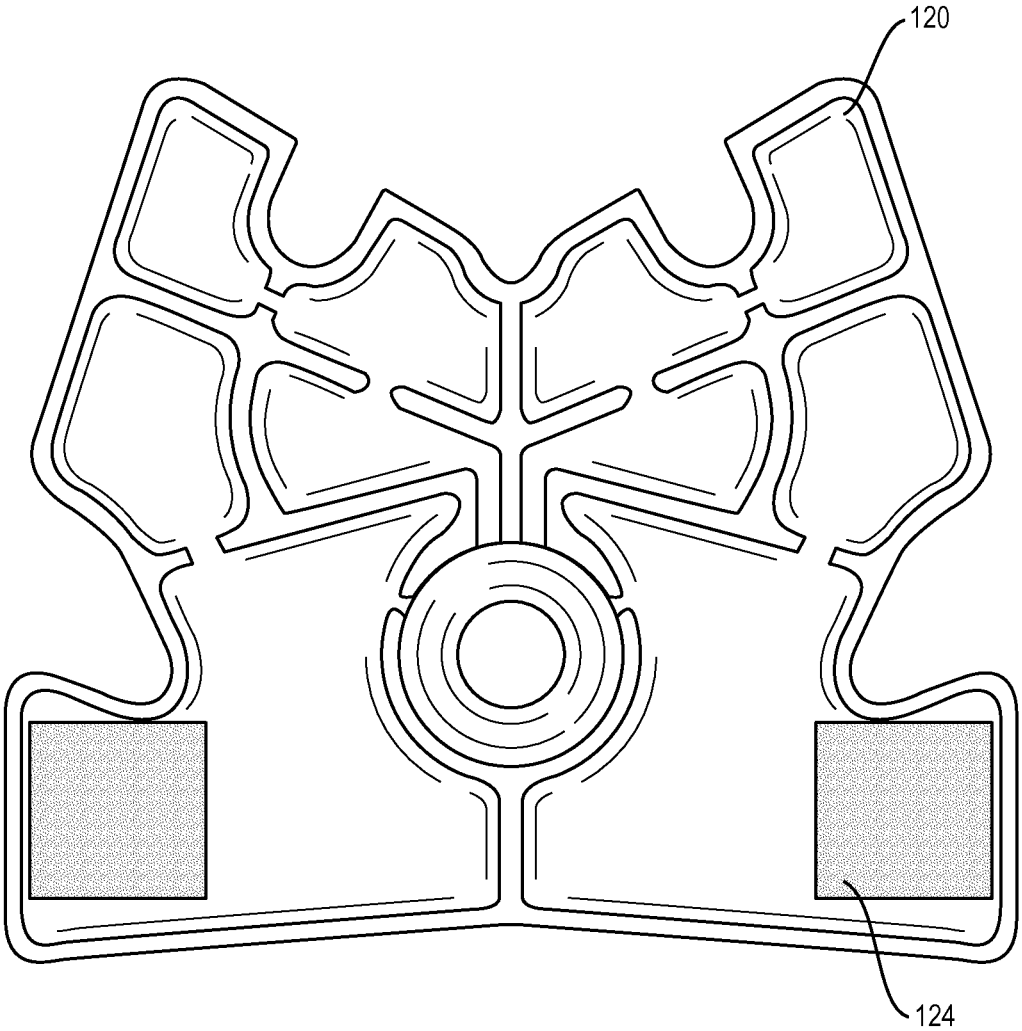
FIG. 17 is a bottom plan view of the inflatable back liner system of FIG. 13.
Figure 24:
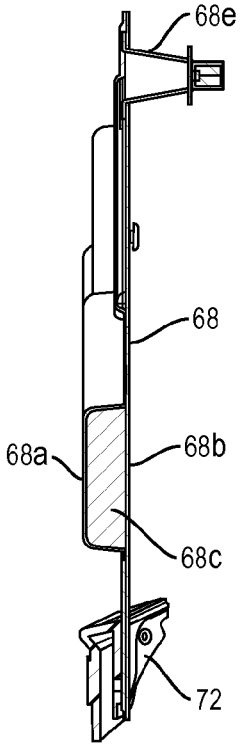
FIG. 24 is a sectional view taken along line 24-24 of FIG. 23, of the lateral liner.

Each of the liners comprises inner and outer plastic sheets 68*a*, 68*b* made of thin (e.g. 0.02 to 0.04 inches) TPU sheets (see FIG. 24) that are sealed to each other around their perimeter and elsewhere to form a plurality of pockets containing a plurality of triangular foam members as shown in FIG. 17 and at 68*c* in FIG. 24. The front liner 62 also comprises a quadrangular foam member 62*a* in FIG. 18. The crown liner 64 comprises six triangular foam members 64*a* around a center of the liner and a further triangular member at the back. The pair of side cushion assemblies 66 each comprise five staggered triangular foam members, and the back cushion assembly 68 comprises seven more triangular foam members, all spaced about the back and sides of the padding system 12 for providing comfortable support for the wearer's head.

Figure 25:
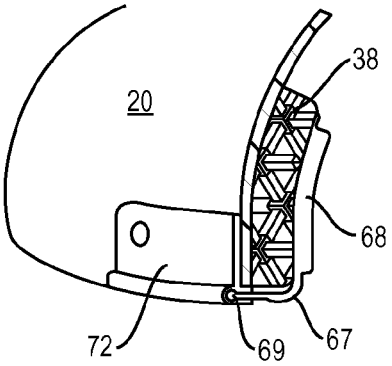
FIG. 25 is an detail view of the connection between the lateral liner and a back bumper of the helmet.

The back cushion assembly 68 (FIG. 23) also includes an extension of the inner and outer plastic sheets forming a ribbon connector 67 having a bead 69 near its end. As seen in FIG. 2, the helmet includes a back bumper 72 for receiving and holding the bead, the back bumper 72 having a slot so as to be removably engaged over a lower central edge of the back portion 20 of the shell as also shown in FIG. 25, for holding the back cushion assembly 68 against the back pad 38.

The front liner 62 as shown in FIG. 17, has the one quadrangular foam member 62*a* at its center and a pair of triangular members 62*h* at either side as well as a further pair of triangular members 62*i* above the quadrangular foam member 62*a*. The foam members 62*a* and 62*h* that are positioned to engage the forehead of the wearer, are made of a harder foam than the other foam members 62*i* of front liner 62 and of all other the foam members of the crown and the lateral liners 64 and 66, 68. In the preferred embodiment of the invention, this harder foam is PORON® brand microcellular urethane sold by Rogers Corporation and having a hardness between about 15 and 21 Shore "O" durometer or preferably 18 Shore "O" durometer. The other softer triangular foam members of the front, crown and the lateral liners are made of polyether polyurethane with 25% compression of 2 psi and Shore "O" durometer of 3 to 10 less than the PORON® brand microcellular urethane.

The liners also comprise at least one relatively thin foam member 62*e* between the inner and outer plastic sheets 62*f*, 62*g* and under the relatively thick members 62*a* in some of the pockets that is made of the softer foam.

Figure 18:
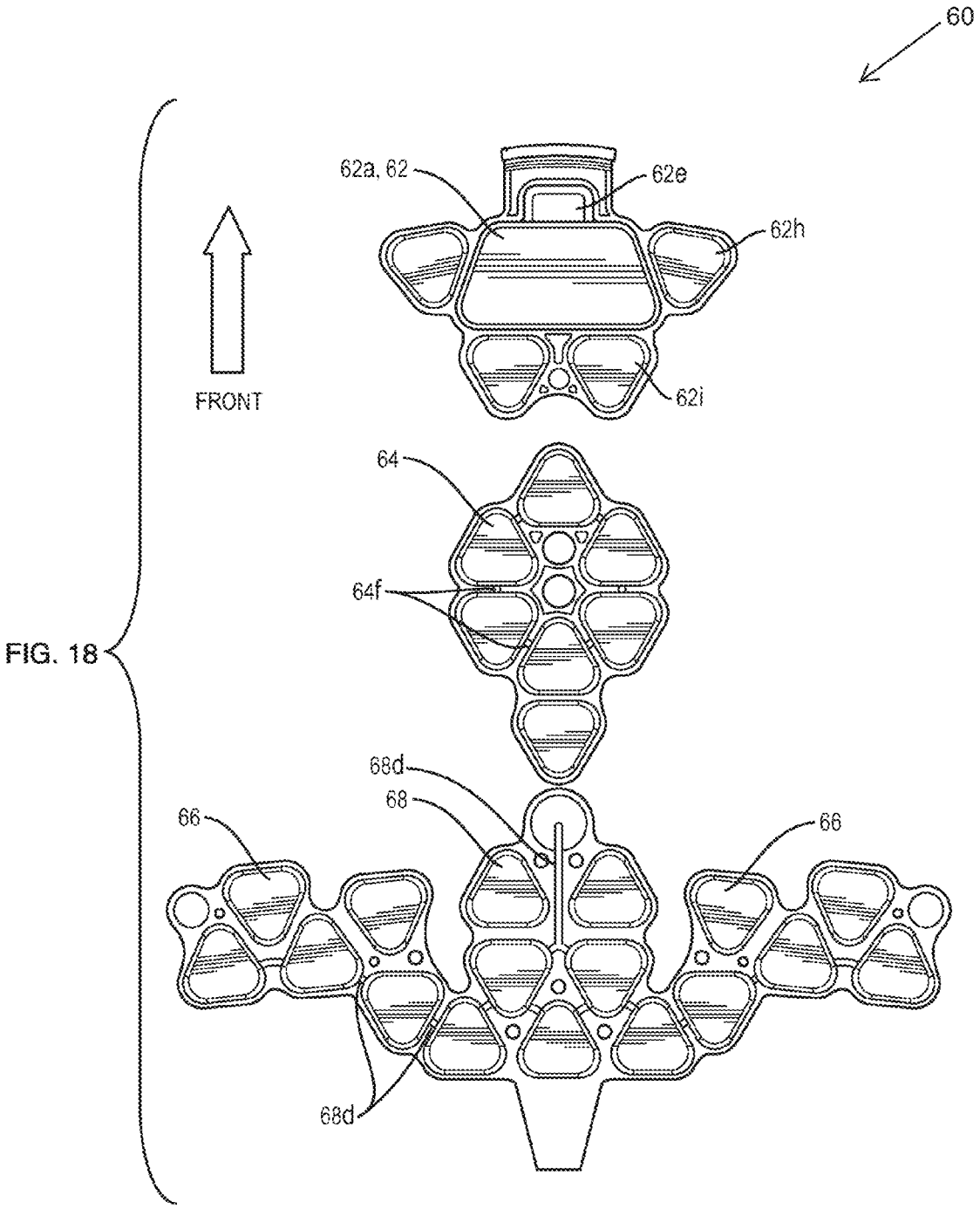
FIG. 18 is a plan view of the comfort liner assembly laid out and with the inner surfaces showing for easier understanding.

The sealed plastic sheets 62*f*, 62*g* for creating the pockets of the crown liner 64 and lateral liner 66, can be inflated with air via inflating fittings 64*b* and 68*e* connected to the outer sheets of the crown liner 64 and the lateral liner 66, 68 for adding air into at least some of the pockets of the crown liner 64 and lateral liner 66 for creating a closer fit for the comfort liner assembly and the wearer's head. To this end and as shown in FIG. 18, the inner and outer sheets of plastic are sealed around and between the pockets as well, except in the areas of air channels 64*f* and 68*d* in the crown liner 64 and lateral liner 66 where air can be channeled from the pocket that is directly connected to the fittings 64*b* and 68*e*, to at least some of the other pockets in each of these liners.

The inflating fittings 64*b* and 68*e* extend in recesses in the upper edge of the back pad 38 and in the back edge of the crown pad 34 seen in FIGS. 4-6, and are held by hook-and-loop rings to the inner surface of the helmet shell. Two holes through the shell, to the rear of the upper screw 53 in FIG. 1 for holding the crown pad to the shell, permit an inflating pin to have access to the inflating fittings for inflating the crown liner 64 and lateral liner 66 after the wearer has put the helmet on, for a close and comfortable custom fitting of the helmet to the wearer's head.

Figure 7:
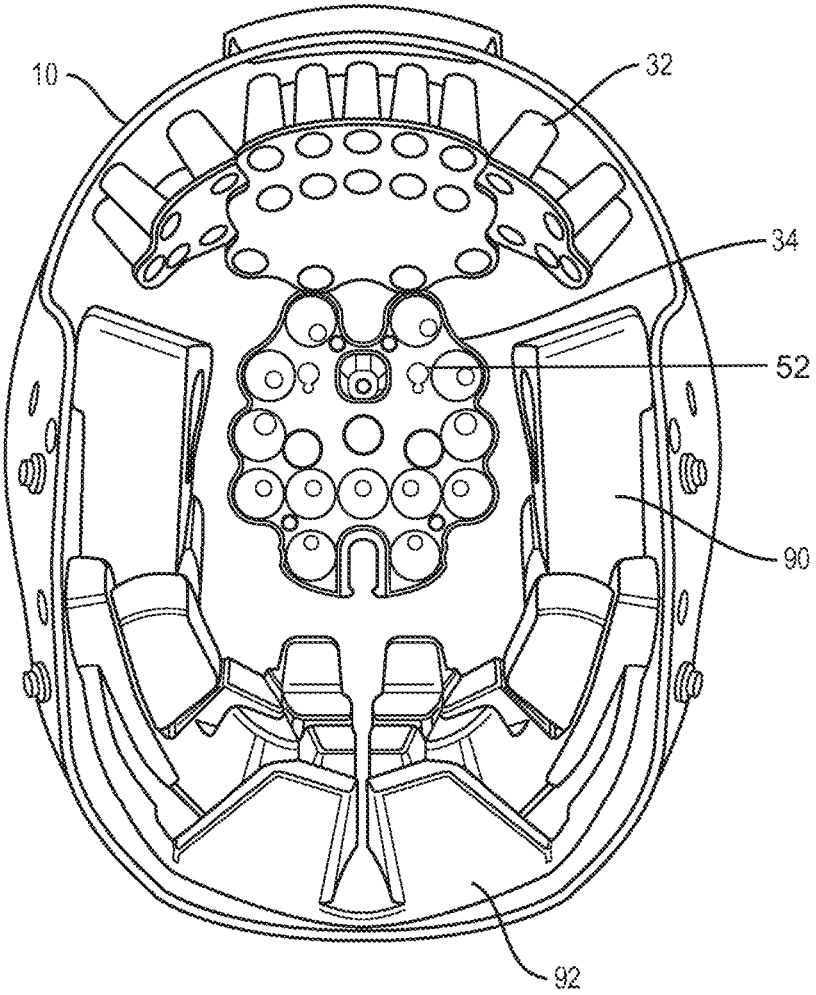
FIG. 7 is a bottom plan view of the helmet-and-padding assembly, revealing the arrangement of the fourth embodiment of the padding system inside the helmet but without jaw pads.
Figure 8:
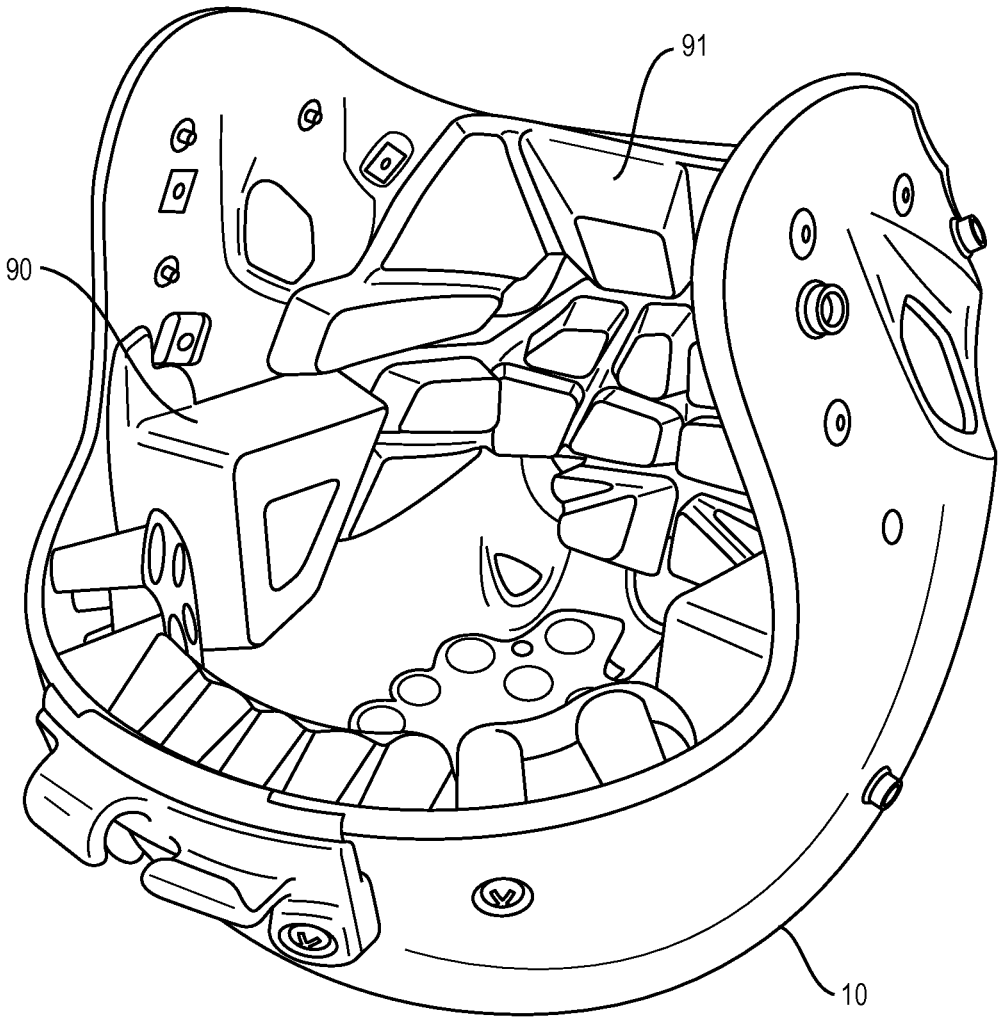
FIG. 8 is a bottom perspective view of the helmet-and-padding assembly, revealing the arrangement of the fourth embodiment of the padding system inside the helmet, again with the jaw pads removed.
Figure 9:
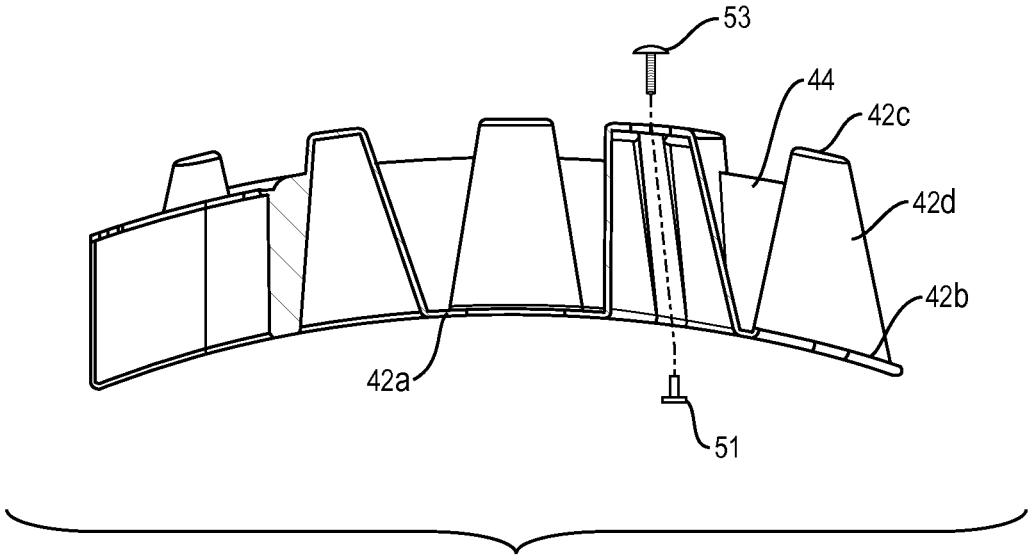
FIG. 9 is a sectional view of the crown pad shown in FIGS. 4-8, taken along line 9-9 of FIG. 4.

With reference to FIGS. 7 and 8, in a further embodiment of the invention, in place of the single-layer side padding 36 and back padding 38, there is provided a dilatant cushioning 90, 92. The dilatant cushioning 90, 92 is a shear-thickening material. As used in the present application, the term "shear-thickening" refers to a material whose viscosity increases with the rate of shear strain. Such a shear thickening fluid—also known to those of skill in the field by the acronym "STF," is an example of a non-Newtonian fluid. In the preferred embodiment of the invention, this dilatant cushioning is D3O® brand cushioning produced by Design Blue Ltd.

The dilatant cushioning is of a type that its material components, in an undisturbed state—that is, before impact—flow freely when moved slowly, but on shock (such as from an impact to the outside of a helmet during a sporting event), lock together to absorb and disperse energy, before instantly returning to a flexible state. This characteristic provides protection, as well as material flexibility. It also provides both comfort to the wearer during "normal" conditions (e.g., game play where no impact is being experienced). Thus the dilatant cushioning 90, 92 quickly turns a hard state on impact, but returns to the flexible, more comfortable state immediately after the sudden shock or impact force has been removed.

Thus, counter to what is customary or typical in padding systems, the greater the force of the impact, the more the molecules lock together and the greater the protection. Therefore, the stress vs. strain characteristics are dependent on the rate of loading. In practice, this means that the harder the impact, the greater the resistance to the force.

An advantage of this material is that it provides significantly-improved impact absorption characteristics over cushioning materials that are currently employed in the art. For example, 3 mm thereof has been found to transmit 57% less force than 10 mm of EVA, despite being 60% thinner. In these embodiments, 6 mm of the material decreases the transmitted force by 79% compared with 10 mm of EVA.

Another advantage is that this material is of a type that is fully-effective and stable in a wide range of temperature environments, an important feature for helmets, whether for sports or other applications, in which heat is generated within the helmet due to long contact with a wearer's head. Depending on the work or recreational environment in which the helmet is being employed, there may be significant amounts of heat supplied from the outside environment, as well.

With reference to FIGS. 11-14, the presently claimed invention may be employed in a lacrosse helmet 80. In this embodiment, the single-layer crown pad 84 is of one piece with the crown comfort liner 94 and the side pads 86 are of one piece with side comfort liners 96.

Figure 13:
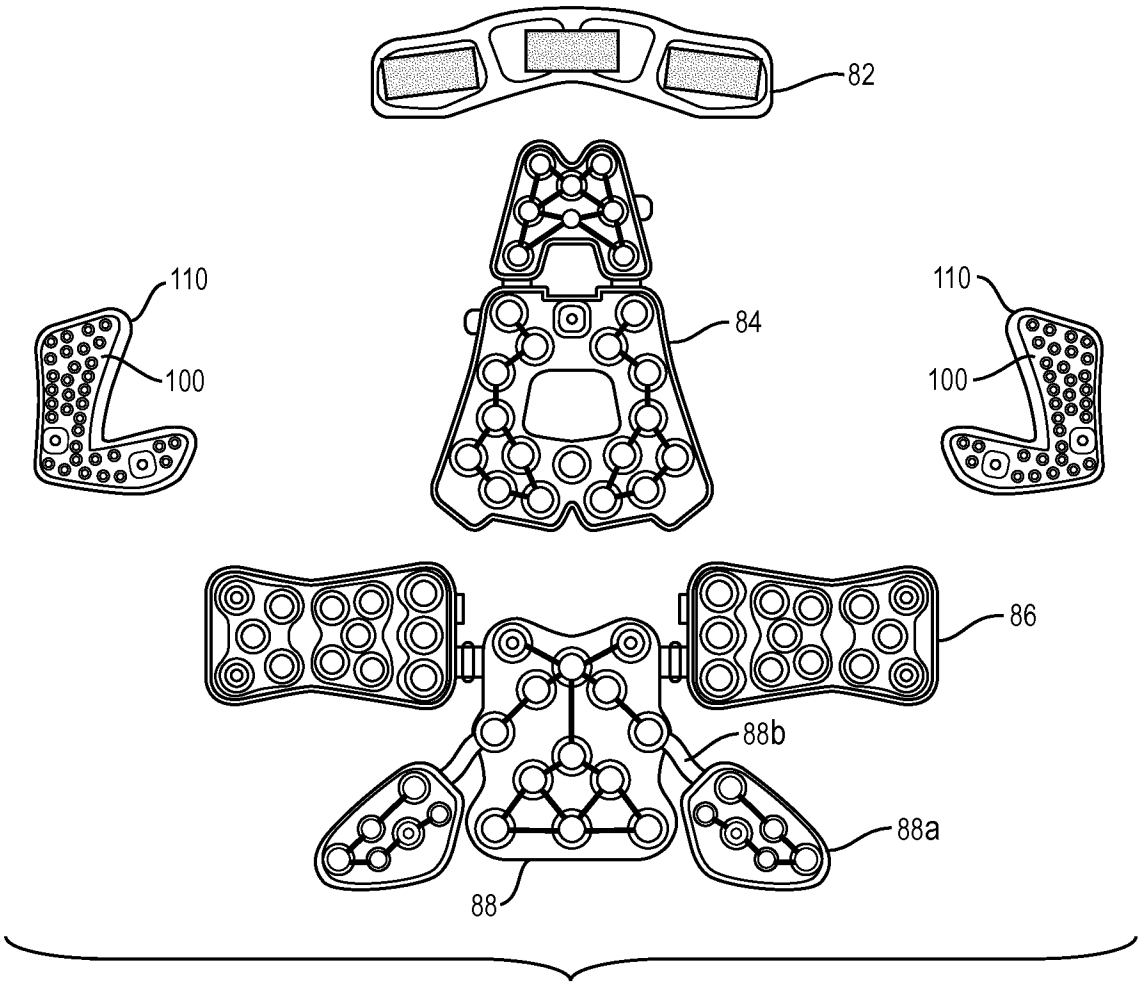
FIG. 13 is a top plan view of the fifth embodiment of the padding system laid out.
Figure 14:
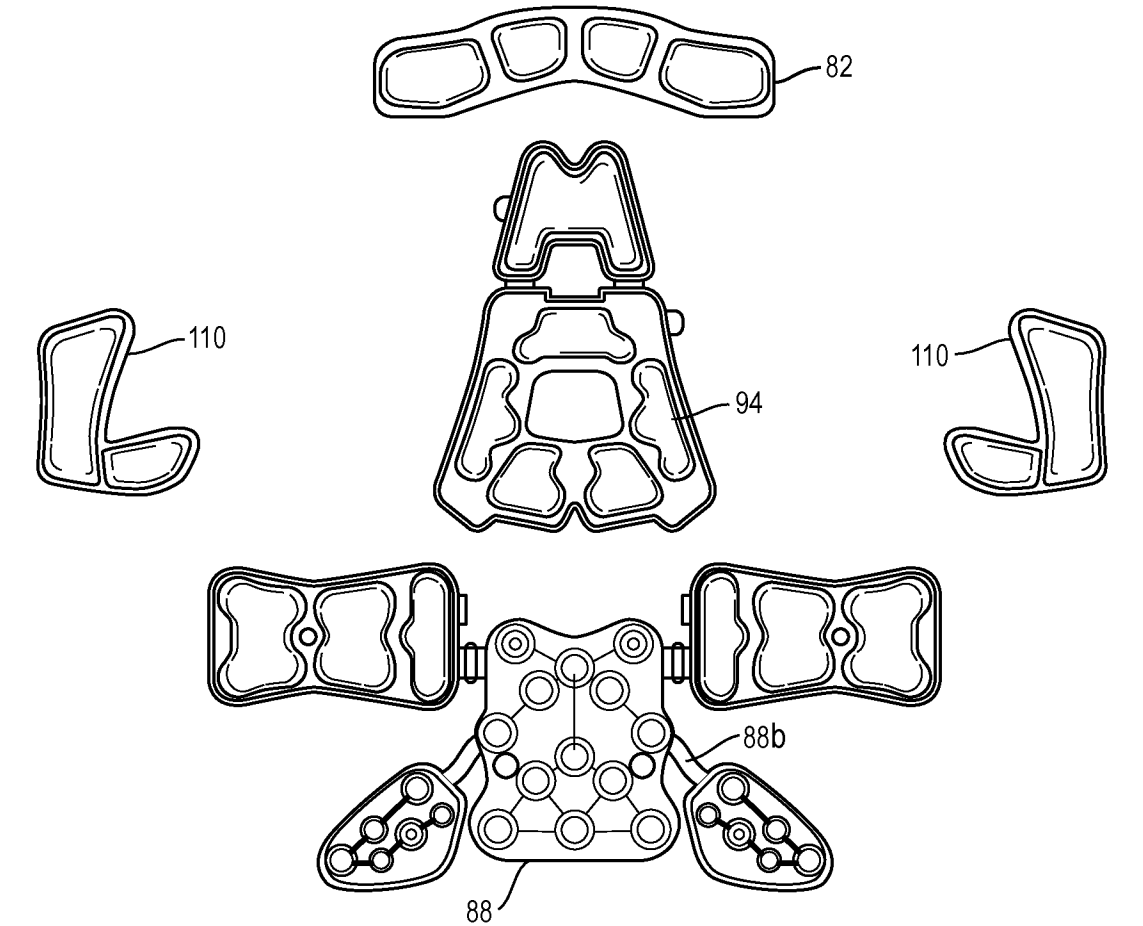
FIG. 14 is a bottom plan view of the fifth embodiment of the padding system laid out.

The back pad 88 is provided on its bottom with foam padding 98 which may be removably attached to the back pad 88 by hook and loop fasteners. In certain embodiments, this foam padding 98 is molded EVA. As can be seen in FIGS. 13 and 14, the back pad has two wing parts 88*a*, which provide a strong advantage, that is freedom to orient the back pad in the most ideal or convenient manner for ultimate protection. The wings 88*a* are connected to the main part of the back pad by a ribbon 88*b*.

This embodiment also includes a pair of jaw pads 100 connected to the inner surface of the helmet by mechanical fasteners extending through the helmet 80, such as T-nuts, in the manner discussed with respect to previous embodiments. The jaw pads 100 also have a foam padding 110 removably attached to their back sides. In certain embodiments, this foam padding 110 is molded EVA.

In the lacrosse helmet embodiment, the front pad 82 is comprised of a plurality of pockets containing a stiff foam for maximal protection.

As with the previous embodiments, the side pads 86 are softer than the crown pad 84 and back pad 88, and in certain embodiments, have no ribs.

Figure 15:
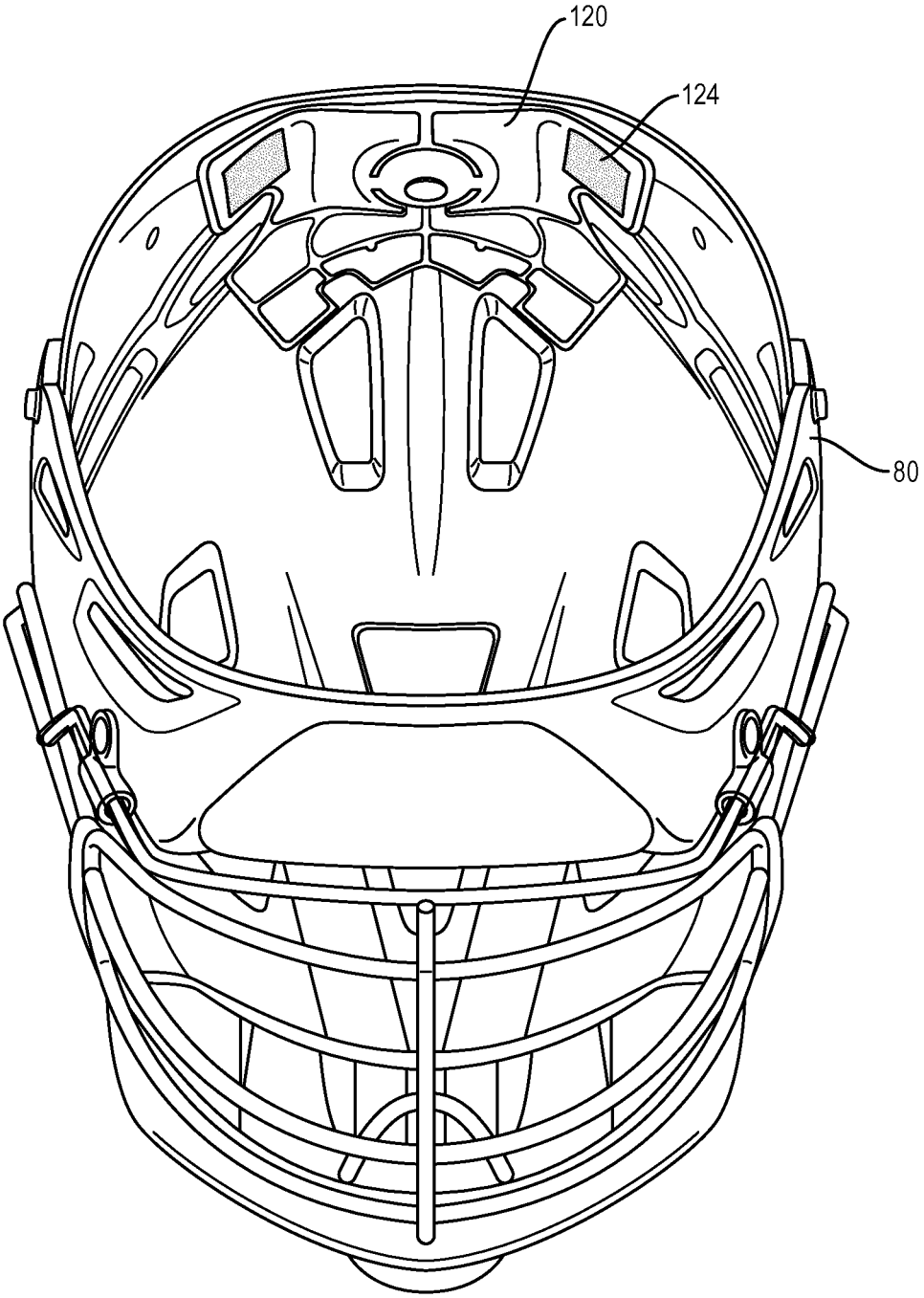
FIG. 15 is a bottom plan view of the helmet of FIG. 11, with the padding removed to reveal an inflatable back liner system inside the helmet.
Figure 16:
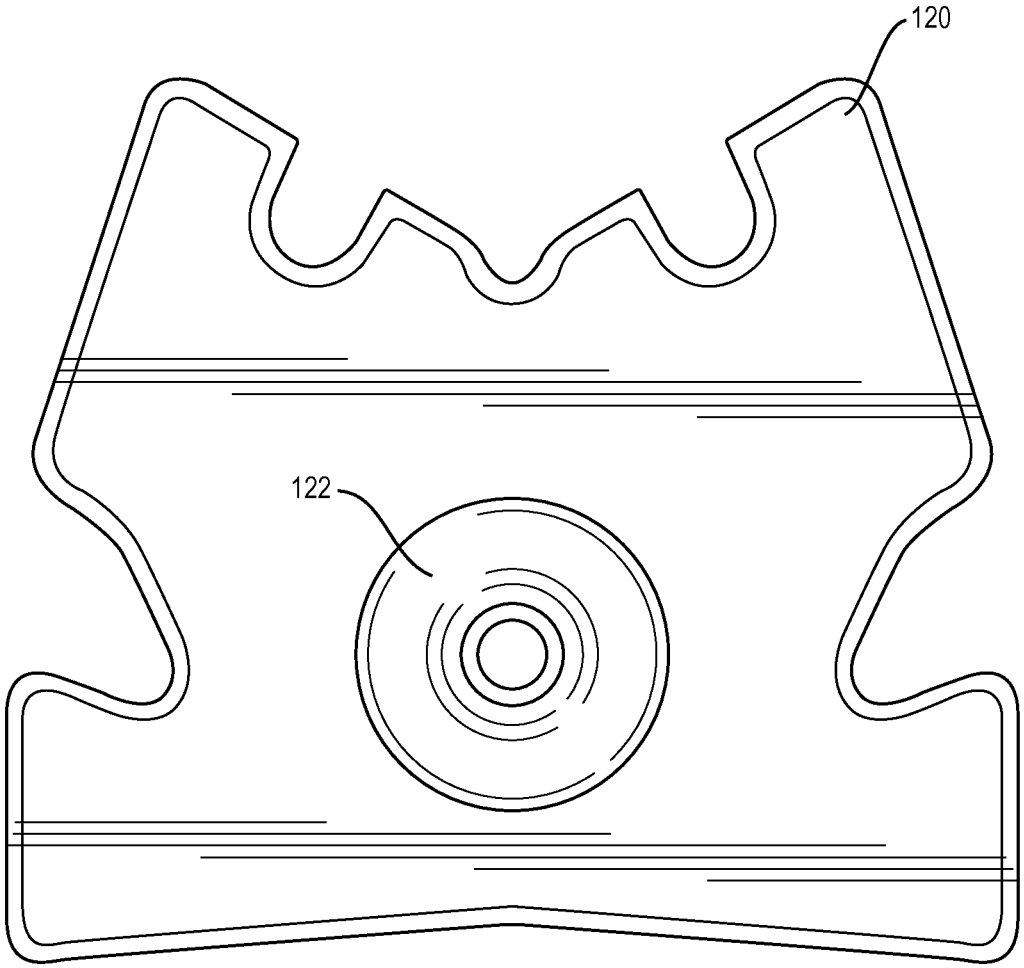
FIG. 16 is a top plan view of the inflatable back liner system of FIG. 13.

As shown in FIGS. 15-17, it is within the scope of the invention to provide an inflatable air-liner system 120 inside the helmet 80, which provides improved fitting of the helmet 80 on the head of a wearer. The inflatable air liner system 120 may be held by hook-and-loop rings 122 to the inner surface of the helmet shell 80 and by any suitably-shaped hook-and-loop fastener 124 to the back pad 88. The air liner system 120 may be secured to the helmet 80 and the back pad 88 by any suitable means known in the art.

Although FIG. 15 shows the inflatable air liner system 120 inside the back of the lacrosse helmet 80, it is well within the scope of the invention to provide the air liner system 120 in any of the embodiments discussed above and in any area within a helmet 10, 80.

In all of the embodiments discussed above, the single-layer padding system 12 is preferably of the type produced by injection molding. However, it is well within the scope of the invention for the single layer padding system 12 to be produced by any method known in the field, including, but in no way limited to, thermoforming or, any type of thermoforming, including vacuum forming.

While a specific embodiment of the invention has been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention. Thus, all the features of all the embodiments disclosed herein are interchangeable so that any element of any embodiment may be applied to any of the embodiments taught herein.

What is claimed is:

1. A helmet-and-padding assembly, comprising:

a rigid shell (10) adapted to cover the head of a wearer, the rigid shell (10) having an outer surface and an inner surface, the inner surface having selected concave curvatures at various portions of the shell, the shell having a front portion (14), a crown portion (16), a pair of opposite side portions (18), and a back portion (20);

a padding system (12) comprising a plurality of impact absorbing units spaced apart on, and removably attached to the inner surface of the rigid shell, the system (12) comprising:

a front pad (32) removably attached at the front portion (14) of the shell;

a crown pad (34) removably attached at the crown portion (16) of the shell;

a pair of side pads (36) removably attached at the respective side portions (18) of the shell; and a back pad (38) removably attached at the back portion (20) of the shell;

each pad being made of thermoplastic urethane, and comprising:

a sheet (42*a*) having a top side and a bottom side; and a plurality of spaced, impact-absorbing projections (42) integrally formed on the top side of the sheet (42*a*), each of the projections (42) having a top end positioned away from the sheet (42*a*) and in the direction of the inner surface of the rigid shell (10), and an open bottom end in the sheet (42*a*) and having a side wall extending downwardly and outwardly between the top end and the bottom end, the projections (42) having a large diameter base (42*b*) and a small diameter peak (42*c*), the projections (42) having a generally circular cross-section and being resiliently collapsible in a substantially axial direction when subjected to a substantially axial impact load;

a plurality of flat support ribs (44), each of the flat support ribs (44) being continuous with the top side of the sheet (42*a*) and extending up along the side wall of at least one projection (42) to a point at least part way between an edge of the top end of the projection (42) and the top side of the sheet (42*a*), wherein at least some of the impact-absorbing projections (42) are oriented such that their intermediate walls are inclined to a major incident component of an impacting force, and wherein some of the impact absorbing units cooperate to afford mutual support in absorbing an impacting force, wherein the padding system (12) has variable rigidity, wherein the rigidity is the greatest at a region of the impact-absorbing unit which is arranged proximate to a bottom region of the front portion of the inner surface of the helmet, wherein the rigidity is least at a region of the impact-absorbing unit which is arranged proximate to the crown portion of the inner surface of the helmet, wherein the height and number of the plurality of flat support ribs (44) decreases upwards along the system (12) from the bottom region of the front portion of the inner surface of the helmet to the crown portion of the inner surface of the helmet, wherein, at a region of the impact-absorbing unit which is arranged proximate to an upper region of the front portion of the inner surface of the helmet, the rigidity is less than the rigidity at the region of the impact-absorbing unit which is arranged proximate to a bottom region of the front portion of the inner surface of the helmet and greater than the rigidity at the region of the impact-absorbing unit which is arranged proximate to the crown portion of the inner surface of the helmet, wherein the variable rigidity is due at least in part to a variation in the plurality of flat support ribs (44) provided in the first region and the second region, and wherein the side pads (36) are provided with T-ribbing (36*a*) for enhanced rigidity at select regions of the side pads (36), the T-ribbing (36*a*) consisting of a T-shaped piece of thermoplastic polyurethane plastic fused to the peaks (42*c*) of the plurality of projections (42) of each of the side pads, but not all of the plurality of projections (42).

2. The protective helmet-and-padding assembly according to claim 1, wherein the impact-adsorbing projections (42) are frustoconical in shape.

3. The protective helmet-and-padding assembly according to claim 1, wherein at least one of the projections (42) has an opening for accommodating a fastening means.

4. The protective helmet-and-padding assembly according to claim 1, wherein the impact absorbing units vary from one another in rigidity.

5. The protective helmet-and-padding assembly according to claim 1, wherein, within at least one of the impact absorbing units, the rigidity of a first region is different from the rigidity of a second region.

6. The protective helmet-and-padding assembly according to claim 5, wherein the variable rigidity is due at least in part to a variation in the height of the flat support ribs (44) provided in the first region and the second region.

7. The protective helmet-and-padding assembly according to claim 1, wherein at least one of the impact absorbing units has a durometer in the range of about 75 Shore-A to about 115 Shore-A.

8. The protective helmet-and-padding assembly according to claim 7, wherein at least one of the impact absorbing units has a durometer in the range of about 85 Shore-A to about 105 Shore-A.

9. The protective helmet-and-padding assembly according to claim 8, wherein at least one of the impact absorbing units has a durometer in the range of about 90 Shore-A to about 100 Shore-A.

10. The protective helmet-and-padding assembly according to claim 1, further comprising a dilatant cushioning (90, 92) along the inner surface of the helmet shell (12).

11. The protective helmet-and-padding assembly according to claim 10, wherein the dilatant cushioning is a shear-thickening material.

12. The protective helmet-and-padding assembly according to claim 1, further comprising an inflatable air-liner system (120) along the inner surface of the helmet shell (12).

13. The protective helmet-and-padding assembly according to claim 1, wherein the helmet shell (12) is a helmet selected from the group consisting of a football helmet, a lacrosse helmet, a baseball helmet and a softball helmet.

14. The protective helmet-and-padding assembly according to claim 1, wherein a bottom side of the sheet (42*a*) is adapted to face a head of a wearer.

15. The protective helmet-and-padding assembly according to claim 1, wherein the thickness of the side wall (42*d*) is in the range of about 0.025 inches and about 0.075 inches.

16. The protective helmet-and-padding assembly according to claim 15, wherein the thickness of the side wall (42*d*) is in the range of about 0.030 inches and about 0.065 inches.

17. The protective helmet-and-padding assembly according to claim 16, wherein the thickness of the side wall (42*d*) is in the range of about 0.035 inches and about 0.060 inches.

18. The protective helmet-and-padding assembly according to claim 1, wherein the diameter of the large diameter base (42*b*) is in the range of about 0.1875 inches and about 0.9000 inches.

19. The protective helmet-and-padding assembly according to claim 1, wherein the diameter of the small diameter peak (42*c*) is in the range of about 0.2500 inches and about 0.9000 inches.

20. The protective helmet-and-padding assembly according to claim 1, wherein the height of the projections (42) is in the range of about 0.10 inches and about 1.8 inches.

21. The protective helmet-and-padding assembly according to claim 20, wherein the height of the projections (42) is in the range of about 0.15 inches and about 1.65 inches.

22. The protective helmet-and-padding assembly according to claim 21, wherein the height of the projections (42) is in the range of about 0.17 inches and about 1.5 inches.

23. A padding system comprising:

a plurality of impact absorbing units spaced apart on, and removably attached to the inner surface of a rigid shell, the system (12) comprising:

a front pad (32) removably attached at the front portion (14) of the shell;

a crown pad (34) removably attached at the crown portion (16) of the shell;

a pair of side pads (36) removably attached at the respective side portions (18) of the shell; and a back pad (38) removably attached at the back portion (20) of the shell;

each pad being made of thermoplastic urethane, and comprising:

a sheet (42*a*) having a top side and a bottom side; and a plurality of spaced, impact-absorbing projections (42) integrally formed on the top side of the sheet (42*a*), each of the projections (42) having a top end positioned away from the sheet (42*a*) and an open bottom end in the sheet (42*a*) and having a side wall extending downwardly and outwardly between the top end and the bottom end, the projections (42) having a generally circular cross-section and being resiliently collapsible in a substantially axial direction when subjected to a substantially axial impact load;

a plurality of flat support ribs (44), each of the flat support ribs (44) being continuous with the top side of the sheet (42*a*) and extending up along the side wall of at least one projection (42) to a point at least part way between an edge of the top end of the projection (42) and the top side of the sheet (42*a*), wherein the rigidity of a first region of the impact absorbing unit is different from the rigidity of a second region, wherein the difference in rigidity is due at least in part to a variation in the height of the flat support ribs (44) provided in the first region and the second region, and wherein the side pads (36) are provided with T-ribbing (36*a*) for enhanced rigidity at select regions of the side pads (36), the T-ribbing (36*a*) consisting of a T-shaped piece of thermoplastic polyurethane plastic fused to the peaks (42*c*) of the plurality of projections (42) of each of the side pads, but not all of the plurality of projections.

* * * * *